US007143529B2

(12) United States Patent
Robinson, Jr. et al.

(10) Patent No.: US 7,143,529 B2
(45) Date of Patent: Dec. 5, 2006

(54) TORSION MANAGEMENT OUTSOLES AND SHOES INCLUDING SUCH OUTSOLES

(75) Inventors: Douglas K. Robinson, Jr., Mansfield, MA (US); John J. Erickson, Brockton, MA (US); John F. Lane, III, Weymouth, MA (US); James M. Feeney, Dedham, MA (US); Hetal M. Parekh, Framingham, MA (US)

(73) Assignee: Acushnet Company, Fairhaven, MA (US)

( * ) Notice: Subject to any disclaimer, the term of this patent is extended or adjusted under 35 U.S.C. 154(b) by 449 days.

(21) Appl. No.: 10/799,119

(22) Filed: Mar. 12, 2004

(65) Prior Publication Data

US 2006/0130361 A1 Jun. 22, 2006

Related U.S. Application Data

(63) Continuation-in-part of application No. 10/047,320, filed on Jan. 14, 2002, now Pat. No. 6,708,426.

(51) Int. Cl.
*A43B 13/18* (2006.01)

(52) U.S. Cl. ..... 36/127; 36/102; 36/103

(58) Field of Classification Search ..... 36/127, 36/102, 103, 104, 30 R, 33, 86, 25 R, 31
See application file for complete search history.

(56) References Cited

U.S. PATENT DOCUMENTS

| | | | | |
|---|---|---|---|---|
| 1,964,364 | A * | 6/1934 | Pellkofer | 36/11.5 |
| 2,179,942 | A * | 11/1939 | Lyne | 36/127 |
| 3,550,597 | A | 12/1970 | Coplans | 128/585 |
| 3,742,625 | A * | 7/1973 | Famolare, Jr. | 36/11.5 |
| 3,952,429 | A * | 4/1976 | Thomas | 36/31 |
| 4,573,457 | A * | 3/1986 | Parks | 602/29 |
| 4,608,970 | A | 9/1986 | Marck et al. | 128/80 J |
| 5,243,776 | A | 9/1993 | Zelinko | 36/134 |
| 5,979,083 | A | 11/1999 | Robinson et al. | 36/127 |
| 6,115,945 | A * | 9/2000 | Ellis, III | 36/102 |
| 6,708,426 | B1 * | 3/2004 | Erickson et al. | 36/127 |

* cited by examiner

*Primary Examiner*—Ted Kavanaugh
(74) *Attorney, Agent, or Firm*—D. Michael Burns

(57) ABSTRACT

The present invention is directed to an outsole for use with a shoe and a shoe having an improved outsole. The outsole includes a forward portion and a rearward portion that are connected by a ball-and-socket connection that allows the portions to move freely. The outsole may include flexible members disposed between discrete pieces of the forward portion to allow these pieces to flex freely. The outsole includes a pair of stabilizer rods. The outsole may be used with a sole construction that includes a gel cushion that is adjacent a transparent window member of the outsole. The outsole has areas of extension for improving the traction and balance of the user.

15 Claims, 6 Drawing Sheets

TORSION MANAGEMENT OUTSOLES AND SHOES INCLUDING SUCH OUTSOLES

CROSS REFERENCE TO RELATED APPLICATION

This application is a continuation-in-part of U.S. application Ser. No. 10/047,320, filed Jan. 14, 2002 now U.S. Pat. No. 6,708,426, which is incorporated herein in its entirety by reference.

TECHNICAL FIELD

The present invention is directed to an outsole. More particularly, the present invention is directed to a golf shoe having an improved outsole that enables greater torsional movement and flexibility of the shoe.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal. In this manner, golf shoes have evolved to provide the wearer with good traction on grass, comfort while walking, and a stable platform for hitting the ball. Typical golf shoes thus have a relatively stiff sole with metal spikes or plastic cleats.

A stiff sole, while providing a stable platform, can nonetheless cause discomfort because there is a balance between how the foot should be allowed to move versus how it should be supported. An example of this is the fact that during walking and at the start and finish of the golf swing, the foot bends at the metatarsal joints (the ball). Aside from the physical effort needed to flex a very stiff sole (which would tend to cause a 'clunky' gait as when wearing clogs), sole stiffness tends to cause the heel of the foot to slide up and down in the heel cup, potentially causing blisters. Thus, golf shoes have evolved to have soles that flex across the ball area to allow this movement without compromising the lateral stability of a good hitting platform.

Relatively recent studies in biomechanics have sought to better quantify how the 26 bones of the foot move relative to each other during human movements. One particular motion that has been identified is a torsional movement about the long axis of the foot. In effect, the forefoot and rearfoot twist relative to each other. It is thought that this movement smoothes the contact between foot and ground, decreasing impacts with the ground as well as providing better ground contact. This observation has led to the development of a golf shoe sole to allow this natural movement.

U.S. Pat. No. Re. 33,194, reissued from U.S. Pat. No. 4,608,970, to Marck et al. discloses an orthopedic device for correcting infants' feet. The device includes a posterior part, an anterior part, and a ball-and-socket for allowing three degrees of freedom between the posterior and anterior parts during set-up. These parts are immobilized in a particular position, when the device is in use. As a result, this device does not assist with the natural torsional-like action of the foot in walking where such action is missing.

U.S. Pat. No. 3,550,597 discloses a device that facilitates the natural rolling action of the foot during movement by providing a flat construction with front and rear main lifting sections rigidly connected to a resilient intermediate section that is twisted into the form of a flat torsion spring. The device applies a yieldable torsional action during use that is applied to the foot by the lifting sections, whereby the heel of the foot is urged upwardly at the inner side and the forefoot is raised upwardly at the outer side, producing a torsional action similar to the natural torsion action of the foot.

Another construction intended to provide greater support to the wearer of the shoe is disclosed in U.S. Pat. No. 5,243,776 to Zelinko. The Zelinko golf shoe has a sole having a forward end, a heel end and an intermediate portion joining the two ends. A spike support plate is journaled to a post extending from the forward end of the shoe. The spike support plate is so mounted to the forward end for rotation about a vertical axis. A biasing means, such as tension springs, is provided to connect the spike support plate to the heel end and for constantly biasing the spike support plate to a neutral (i.e., non-rotated) position and returning the support to that position after the support has been rotated. A cover is provided to protect the biasing means. The Zelinko golf shoe is constructed to allow the forward end of a golfer's foot to remain fixed during a golf swing while the heel rotates.

There remains a need for an improved outsole for a shoe that enables an individual movement of the foot, particularly, the rotation between the rearfoot and the forefoot. By allowing and controlling these rotations, the outsole would resist torsional instability during play, provides independent traction suspension, and increases the flexibility of the shoe to accommodate the movement of the wearer.

SUMMARY OF THE INVENTION

The present invention is directed toward an outsole for a shoe construction having a forward portion, and a rearward portion, coupled together by torsion means at a pivot. The torsion means for coupling includes a pair of angled stabilizer rods. The forward and rearward portions are operatively connected to freely allow independent and relatively reciprocal movement of the forward and rearward portions about the pivot. This movement may occur during a user walking with the outsole or swinging a golf club.

In one embodiment, the forward and rearward portions may be operatively connected discrete pieces. In another embodiment, the outsole may include a rotational connection configured to allow relative movement of the forward and rearward portions.

In yet another embodiment, the present invention is directed to a shoe comprising an outsole and an upper generally configured to accommodate a foot connected to the outsole. The outsole includes a forward portion for supporting the forefoot of a foot and a rearward portion for supporting the heel of the foot. The forward portion defines a chamber. The rearward portion includes a protrusion. The forward and rearward portions are operatively connected when the protrusion is received in the chamber.

In another embodiment, the present invention includes an outsole comprising a first piece, a second piece, and a third piece, each piece separate from each other. A flexible member joins the first piece to the second piece, and another flexible piece joins the second piece to the third piece. The flexible members include a length that is less than the length of each of the adjoining pieces. Furthermore, the material of the flexible member is substantially softer than the first and second piece materials.

In an embodiment of the invention, the outsole comprises the first and second piece materials having a Shore A greater than about 75 and the flexible member material having a Shore A less than about 85. In addition, in such an outsole the first and second piece materials may have a Shore A greater than about 85 and the flexible member material may have a Shore A of about 70.

The present invention provides for rearward and forward soles to have isolated second layers that extend beyond the conventional sole contour for increased traction and area of contact with the turf, therefore greater stability and balance to the user.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
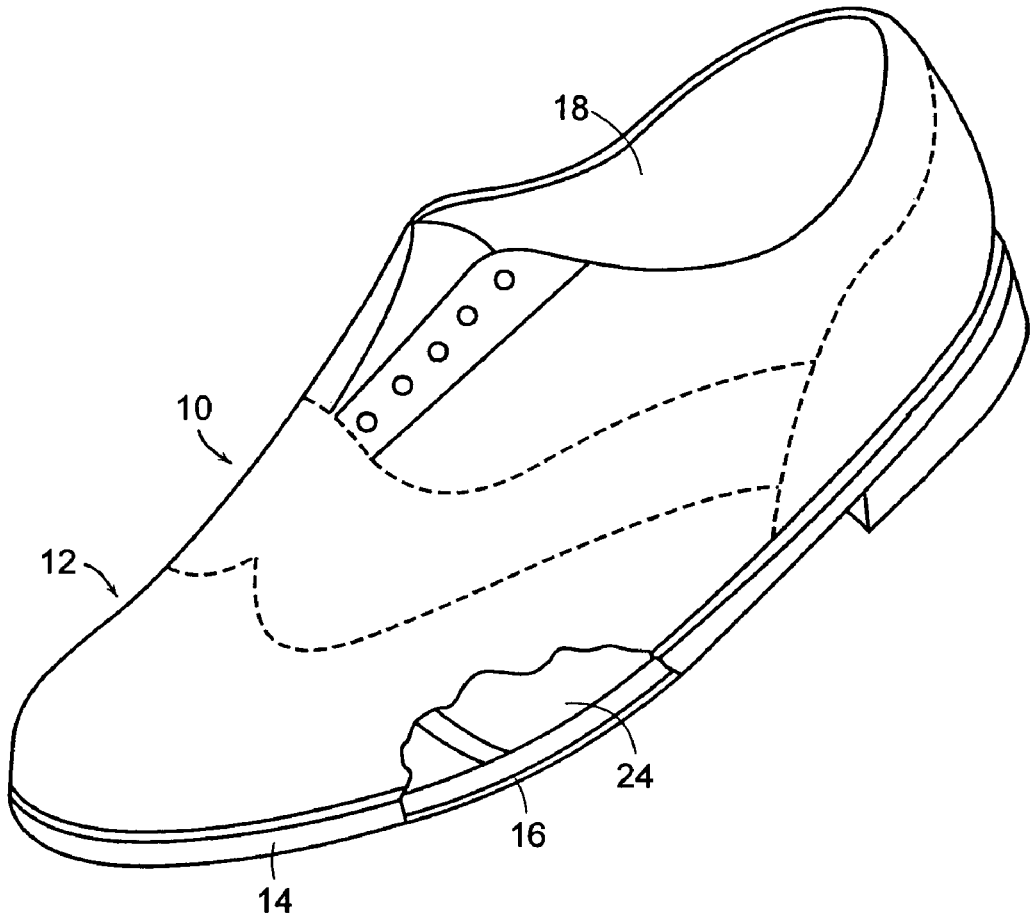
FIG. 1 is a top, perspective view of a golf shoe of the present invention with a portion broken away to expose a mid-sole.

An embodiment of a golf shoe 10 constructed according to the present invention is shown in FIG. 1. The shoe 10 includes an upper 12, a mid-sole 14 joined to the upper 12, and an outsole 16 joined to the mid-sole 14. The upper 12 has a generally conventional shape and is formed from a suitable upper material, such as leather or the like. An opening 18 is formed by the top portion of the upper 12 for receiving a user's foot. Upper 12 is preferably secured to mid-sole 14 with cement or other adhesives using an insole board and conventional techniques, as known by those of ordinary skill in the art.

The mid-sole 14 provides cushioning to the wearer, and is formed of a material such as an ethylene vinyl acetate copolymer (EVA). Preferably, the mid-sole 14 is formed on and about the outsole 16. Alternatively, the mid-sole can be formed separately from the outsole and joined thereto such as by adhesive. Once the mid-sole and outsole are joined, the outsole 16 forms a substantial portion of the bottom of shoe 10.

Figure 2:
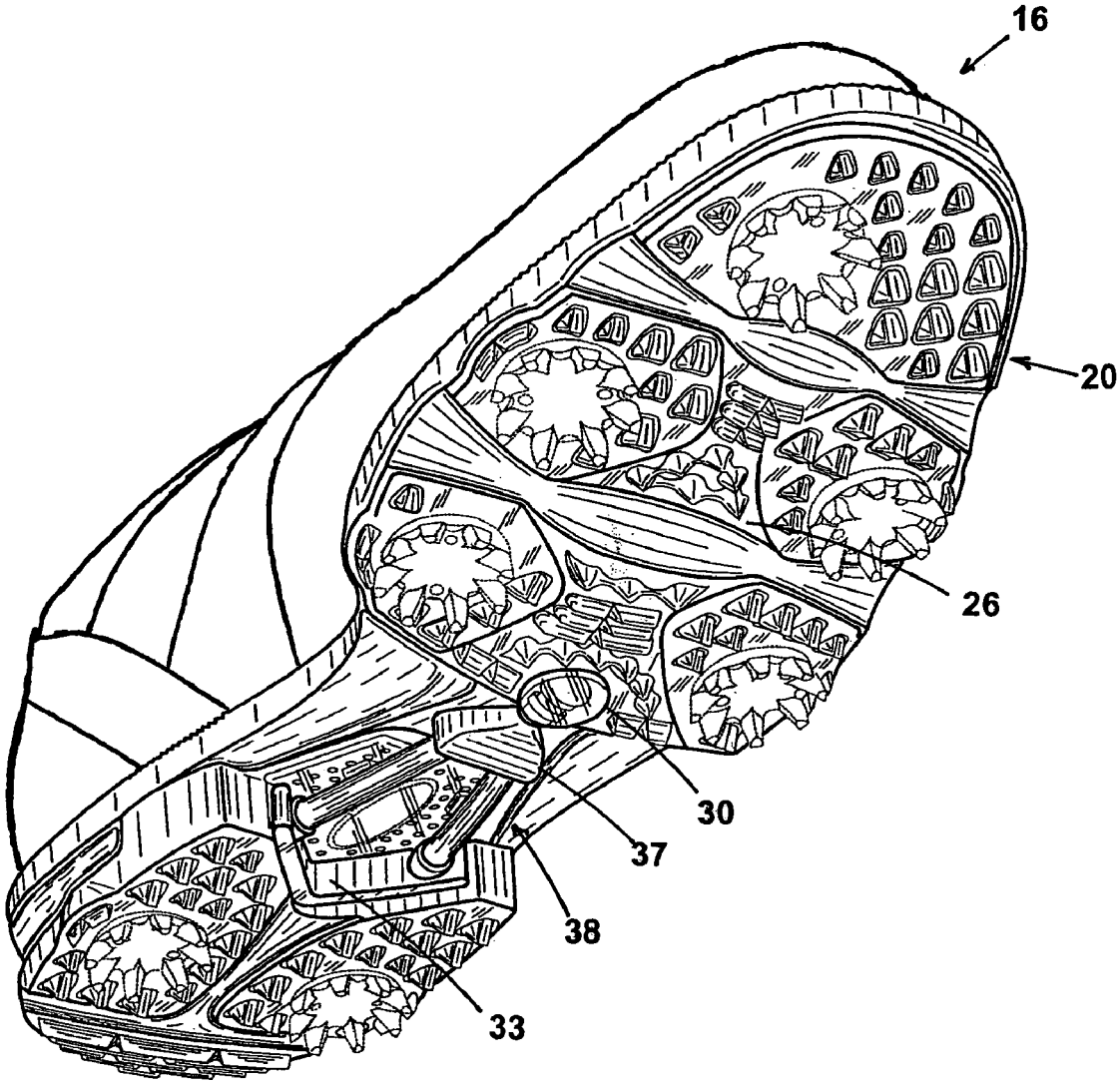
FIG. 2 is a bottom perspective view of an outsole of the present invention golf shoe.
Figure 3:
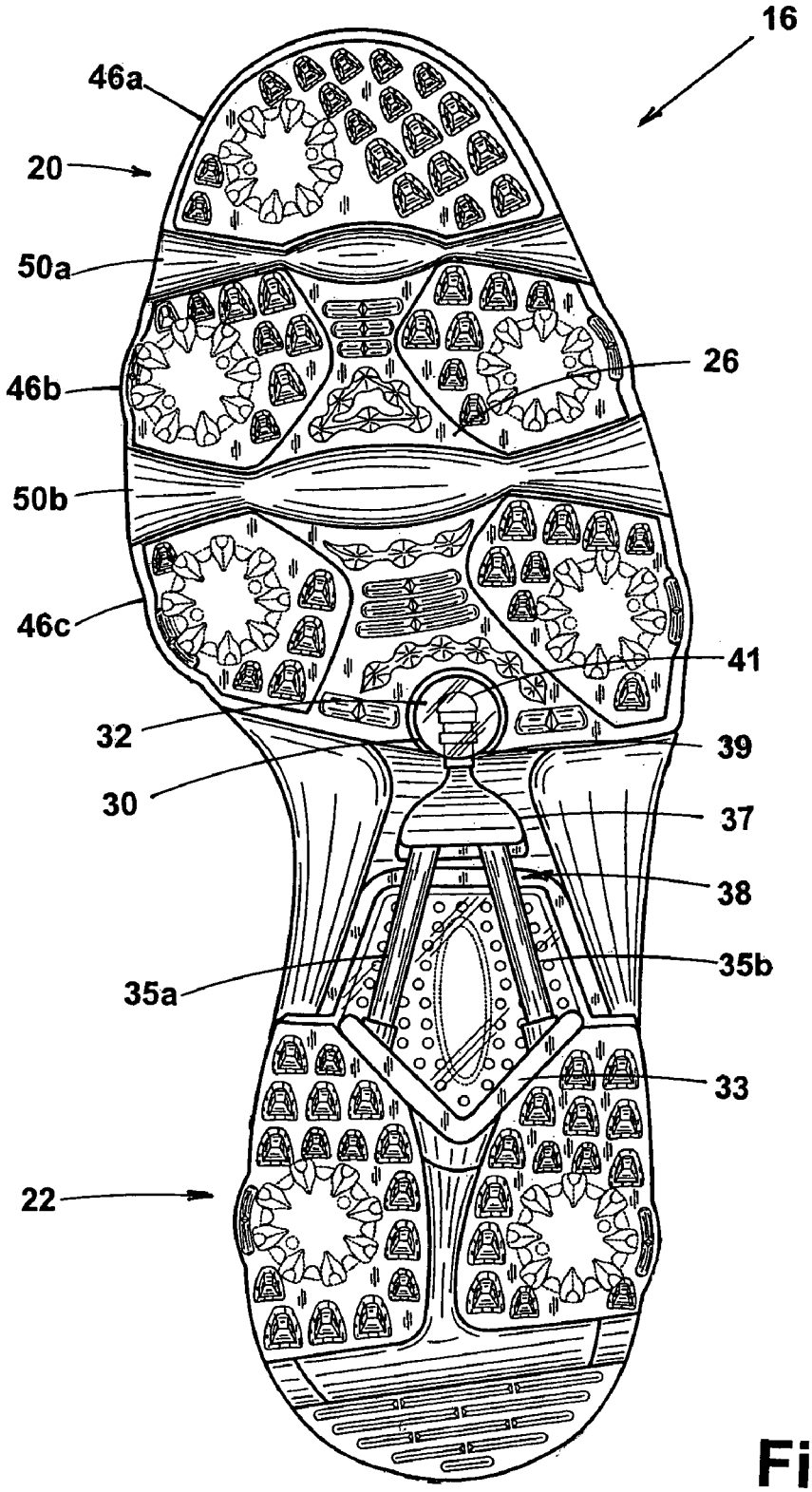
FIG. 3 is a bottom plan view of the outsole.
Figure 4:
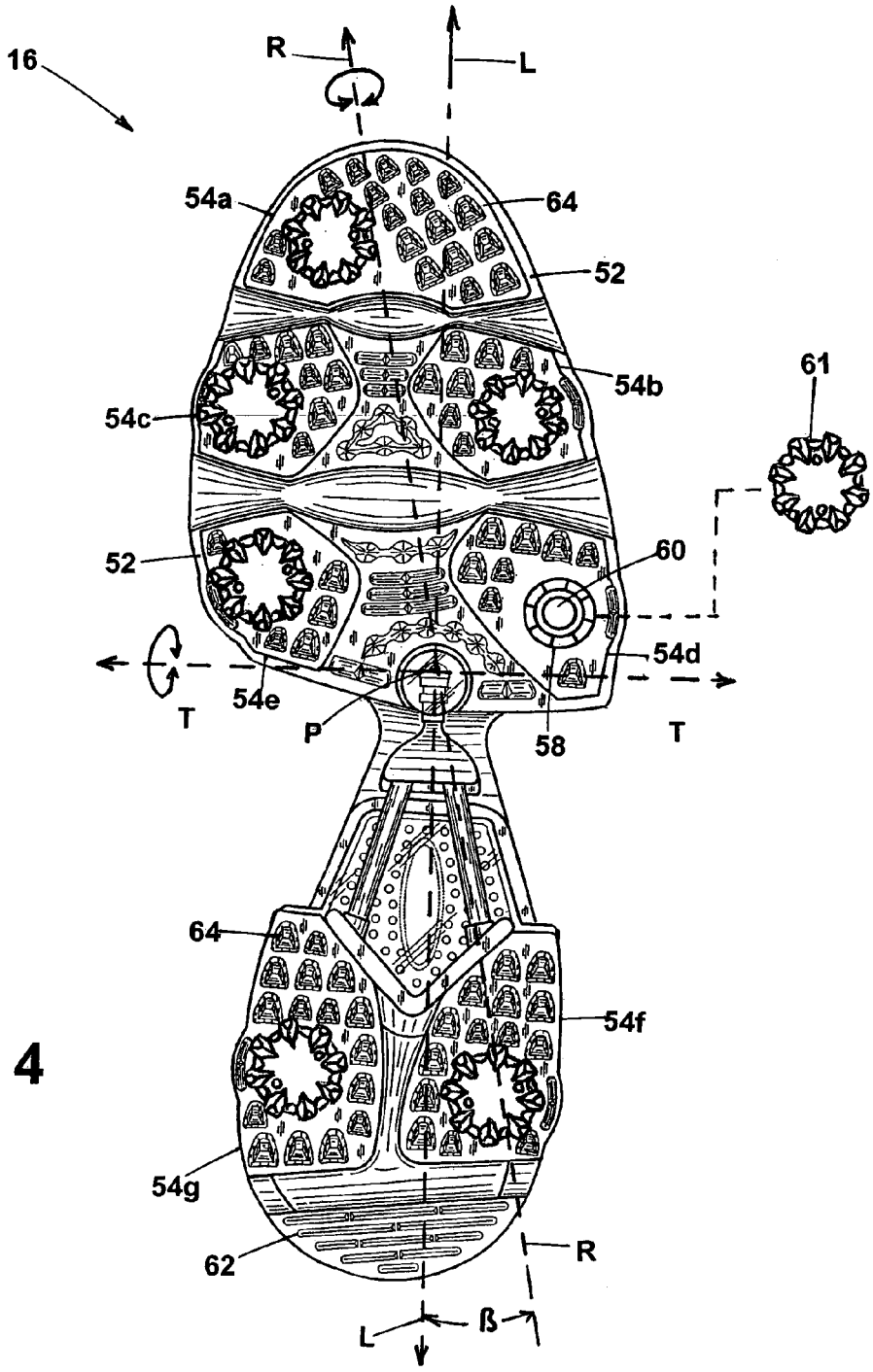
FIG. 4 is a bottom plan view of the outsole depicting the various axis of rotation.

Referring to FIGS. 2 to 4, the outsole 16 includes a forward portion 20 coupled to a separate rearward or shank-heel portion 22. The forward and rearward portions 20 and 22 are discrete pieces connected to permit relative movement there between. The outsole 16 has a top surface 24 and a bottom surface 26, with the mid-sole 14 joined to top surface 24. The bottom surface 26 is configured to contact the turf or ground during use. One preferred mechanism used to couple forward portion 20 to rearward portion 22 includes a connector 30 and a torsion member 38. Connector 30 is positioned at the rearward edge of forward portion 20, and is received in a recess 28 formed in forward portion 20. Preferably, connector 30 has an interior chamber 32 with an opening sized and configured for receiving a protrusion 41 which is at the distal end of a projecting member 39 that extends outwardly from a torsion member 38.

Torsion member 38 interconnects the forward edge of the rearward portion 22 and the rear edge of the forward portion 20 and includes: a V-shaped support section 33 juxtaposed against the rearward portion 22 and having openings defined therein for passage of a pair of stabilizer rods 35*a* and 35*b*, wherein proximal ends of the rods are slidably coupled into channels 67*a* and 67*b* defined in the rearward portion 22; the reciprocating action of the rods 35*a* and 35*b* is generally between about 0.001 inch to about 1.0 inch, and preferably about 0.24 to 0.28 inch; the stabilizer rods 35*a* and 35*b* act as shock absorption devices, and each rod has a distal end extending away from the support section 33 and configured so as to be received in generally cylindrical slots 65*a* and 65*b* defined in an anchor housing 37; and, a projecting member 39 extending from the forward edge of the anchor housing 37 includes an elongated protrusion 41 that is rotatably and resiliently received within the chamber 32 of the connector 30. The stabilizer rods 35*a* and 35*b* are made from such light weight materials as graphite or aluminum, and preferably they are manufactured from titanium. The rods 35*a* and 35*b* are designed such that they are at a distance D from the outsole 16 (see FIG. 6) and while contact with the ground is possible, the amount that each rod may flex is limited by the bottom surface of the outsole. Each rod 35*a* and 35*b* is about 57–60 mm in length and about 5.5–6.0 mm in diameter, and each rod is about 1 to 15 degrees from a longitudinal axis L (FIG. 4), and preferably about 3 to 10 degrees, as discussed further below. As stated above and shown in FIG. 7, the proximal ends of rods 35*a* and 35*b* may slide within channels 67*a* and 67*b* of the rearward portion 22 within the range of about 0.001 to about 1.0 inch, and preferably about 0.24 inch to 0.28 inch.

In a preferred embodiment, connector 30 has an internal chamber 32 for receiving the protrusion 41 to form a rotating socket joint with the ability to reciprocate slightly to absorb the movement of the stabilizer rods 35*a* and 35*b*. In this regard, the distal end of the protrusion 41 preferably has a rounded head and interior chamber 32 serves as a socket. The connector 30 is dimensioned and flexible enough to allow entry of the protrusion 41 into chamber 32, but also will retain the protrusion 41 within the chamber 32.

The interior chamber 32, preferably, has an inner diameter that is slightly larger than the diameter of the protrusion 41, such that there is sufficient clearance to allow the head of the protrusion 41 to rotate within the chamber 32. The inner diameter of the chamber 32 is preferably no more than 0.1 mm greater than the outer diameter of the protrusion 41 to allow movement between the two pieces without excessive free play.

In a preferred embodiment, the connector 30 may be formed of flexible plastic material. A suitable material for the connector 30 is an ester-based thermoplastic polyurethane manufactured by URE-TECH CO., Ltd. located in Taiwan under the name Utechllan UTY-85A. This material is desirable because it is available as a transparent material so that the connection may, if desired, be visible from the top and bottom surfaces 24, 26 of the outsole 16. The connector 30 and housing 37 preferably have a hardness of about 90 Shore A.

Referring to FIG. 4, the outsole 16 further includes a longitudinal axis L that extends longitudinally along the center of rearward portion 22 through the ball-and-socket connection to the forward portion 20 of the outsole 16. A transverse axis T extends transversely across the outsole 16 and through the ball-and-socket connection and is aligned substantially perpendicular to the longitudinal axis L. The protrusion 41 of the projecting member 39 preferably extends along an axis of rotation R that is configured to align with an axis about which the foot naturally rotates or torques during walking and during a golf swing. Projecting member 39 and axis R are preferably offset at an angle β of between about 5 degrees to about 30 degrees, most preferably about 15 degrees with respect to longitudinal axis L. As stated above the stabilizer rods 35*a* and 35*b* angle from the longitudinal axis L at about 1 to 15 degrees, preferably about 3 to 10 degrees.

The ball-and-socket connection defines a pivot P that is positioned to allow natural rotation between the forefoot and rear foot during walking and during a golf swing. In a preferred embodiment, the pivot P is located between the mid-foot and forefoot, preferably just behind the transverse arch of a user at the intersection of the subtalar joint axis and the midtarsal. Pivot P is also preferably located adjacent the exterior of the outsole. The rotational socket connection allows the forward and rearward portions 20 and 22 to move independently, pivotally, and relatively with respect to each other about pivot P. Accordingly, torsional management of the outsole 16 is achieved by allowing the rearward portion 22 to move independently of the forward portion 20 and thereby minimizing any strain that may be caused when the rolling motion of the wearer's foot is constrained by the shoe while walking or swinging a club. Additionally, the coupled connection provided by the ball-and-socket supports the wearer's foot, further providing comfort thereto. Advantageously, a golfer can keep more shoe sole on the ground during a golf swing by not having the heel portion of the shoe torque or lift the forefoot up off the turf.

Figure 5:
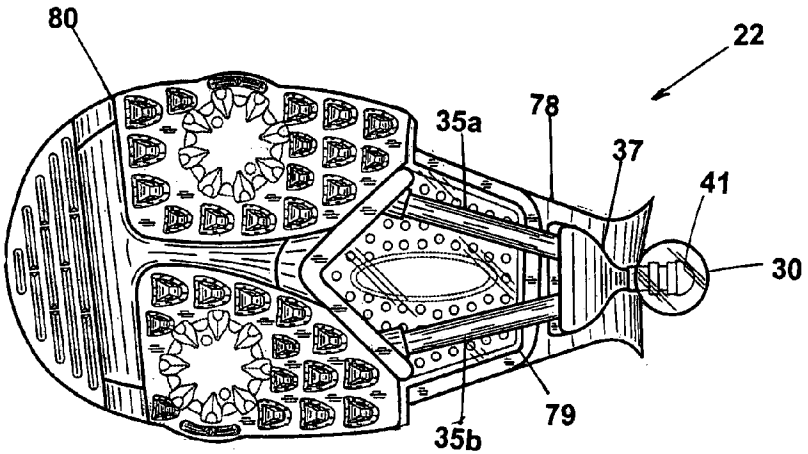
FIG. 5 is a bottom plan view of a rearward portion.

Referring to FIG. 5, the rearward portion 22 includes a shank section 78 and a heel section 80. The shank section 78 includes a stiff member 79, preferably embedded within shank section 78, which is positioned to cover a substantial portion of the mid-foot. Stiff member 79 is preferably made from a kevlar or titanium material, however other stiff material can alternatively be used to have a desirably rigid shank that preferably resists bending. Stiff member 79 does not extend longitudinally into the heel section 80 but rather allows for the heel to collapse and cushion the wearer's heel during walking. During walking and swinging, the trapezoidal-like shape of the shank advantageously focuses the torsional forces exerted upon the rearward portion 22 toward the rotational socket joint and pivot P. Also, because stiff member 79 is difficult to bend, both transversely and rotationally, shank section 78 preferably transmits substantially all of the torsional forces toward the ball-and-socket joint so that a maximum amount of rotation and bending occurs at a single pivot point P. In alternate embodiments shank sections can be curved, or have other shapes.

In one preferred embodiment, as shown on FIG. 3, the forward portion 20 includes a toe piece 46*a*, a discrete mid-foot piece 46*b*, and a forefoot piece 46*c* that is discrete from the mid-foot piece 46*b*. The toe piece 46*a* and the mid-foot piece 46*b* are connected together by a first flexible member 50*a* and the mid-foot piece 46*b* and the forefoot piece 46*c* are connected together by a second flexible member 50*b*. The first flexible member 50*a* has a length less than the length of either of the toe piece 46*a* or the mid-foot piece 46*b*, while the second flexible member 50*b* has a length less than the length of either the mid-foot piece 46*b* or the forefoot piece 46*c*. The rearward portion 22 in this embodiment is a single piece. However, the present invention is not limited to this construction and alternative embodiments, the forward portion 20 can also be formed by a single piece.

It is recommended that the first flexible member 50*a* is preferably located such that it will be generally beneath the distal phalanges area, while the second flexible member 50*b* is preferably located such that it will be substantially below the user's first metatarsal bones. The middle of the second flexible member 50*b* is preferably located directly under the metatarsal heads. This optimally allows for variability of the location of the metatarsal heads by being wider than the flexion axis of the metatarsal heads. As a result, the flexible members 50*a* and 50*b* form hinges and the outsole 16 has good longitudinal flexibility for comfort.

Figure 6:
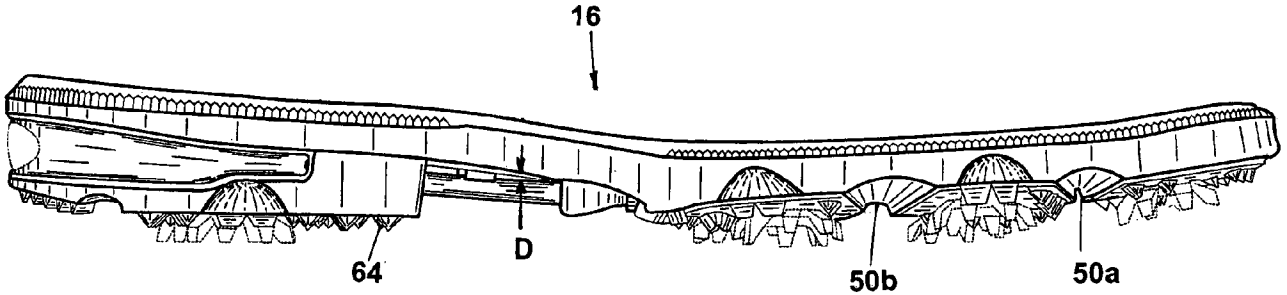
FIG. 6 is a side elevational view of the outsole depicting the spacing of stabilizer rods from a shank section.
Figure 7:
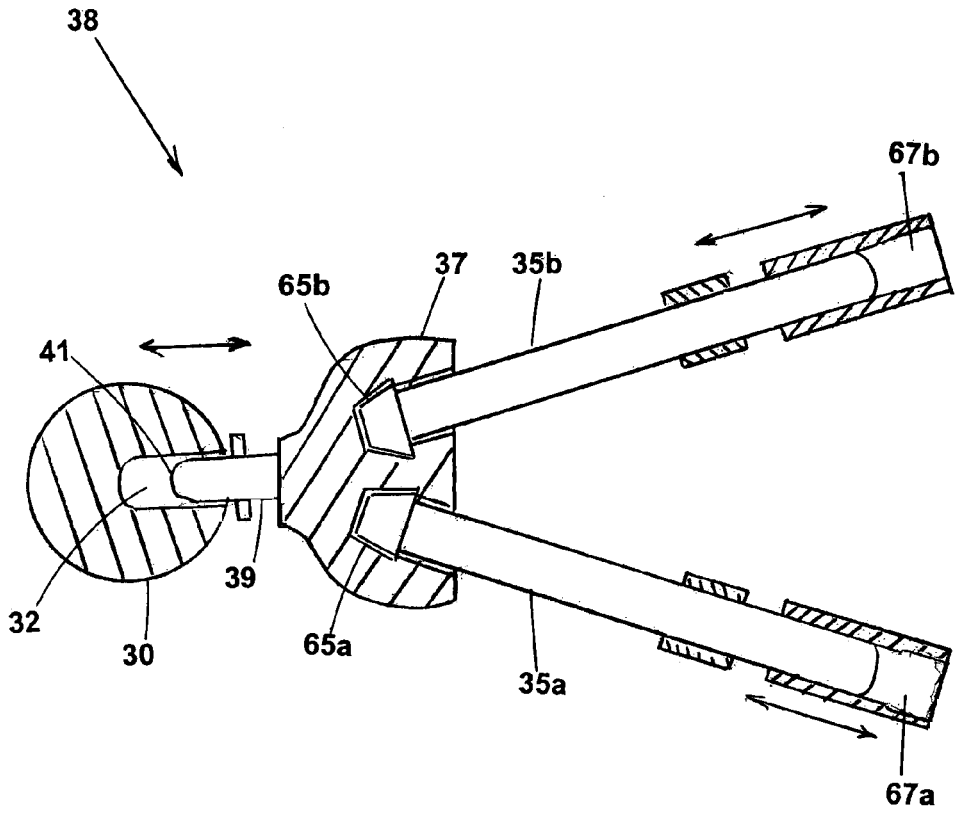
FIG. 7 is a bottom view of the interconnection between the forward and rearward portions.

The flexible members 50*a* and 50*b* are formed to arch upward (as seen in FIG. 6), and are relatively wider at their lateral and medial edges. Preferably, the arched shape is formed during molding. The widths of the lateral edges and medial edges are approximately equal.

Toe piece 46*a*, the mid-foot piece 46*b*, the forefoot piece 46*c*, and rearward portion 22 have similar constructions and preferably include a first or base layer 52 and a second layer formed of discrete exterior or second layer pieces, which are herein referred to as: 54*a* for toe piece 46*a*; 54*b* and 54*c* for mid-foot piece 46*b*; 54*d* and 54*e* for forefoot piece 46*c*; and 54*f* and 54*g* for rearward portion 22. In an alternate embodiment, these components may also be a single-layer construction. It is to be appreciated that the second layers 46*b* to 46*g* are of a design wherein they each have a rounded area extending beyond the dimension of the normal contour of the outsole. This provides the user an increased area of contact with the turf, and therefore greater stability and balance.

The base layer 52 of the outsole 16 forms the inner layer of the outsole and is preferably formed from material that is soft for flexibility in the longitudinal direction. Preferably, the exterior or second layer pieces 54*a–g*, form the outer layer of the outsole 16 that primarily contacts the ground. Preferably, the second layer material is firm for lateral stability. The material of the first or base layer 52 may be softer than or equal to the exterior or second layer material in hardness.

The outsole 16 of the present invention may be formed by various conventional methods. For example, one recommended method is disclosed in U.S. Pat. No. 5,979,083 to Robinson et al., which is hereby incorporated by reference in its entirety. According to this method, the first and second layers are molded together.

In the embodiment shown in FIG. 4, sockets 58 retain cleat receptacles 60 that releasably retain cleats 61 therein. The toe piece 46*a*, mid-foot piece 46*b*, forefoot piece 46*c*, and rearward portion 22 preferably all include cleat receptacles 60.

The first layer 52 further forms sets of projections 62 and 64 that extend therefrom. Sets of projections 62 and 64 are commonly referred to as "spikes" or "cleats," and protrude from the bottom surface of the outsole. These projections 62, and 64 provide traction when the outsole 16 interacts with the ground thereby provide stable support to the golfer especially when the golfer executes a golf shot. These projections 62 and 64 are preferably non-metallic as most golf courses now require spikes or cleats of golf shoes to be non-metallic.

The set of projections 62 extend from the layer 52 without contacting another layer, while the set of projections 64 extend from the layer 52 and extend through the second layer pieces 54*a–g*. In this embodiment, the projections in the set of projections 64 extend through the first layer 52 to insure good adhesion of these components.

Preferably, materials for the first or base layer 52 and second layer pieces 54*a–g*, have a hardness of at least about 70 Shore A. More preferably, the material hardness is at least about 80 Shore A, and most preferably of about 95 Shore A ±3 Shore A. Suitable materials for the first and second layers include without limitation thermoplastic and thermosetting polymers such as thermoplastic urethanes. A specific material of preference is a thermoplastic urethane, U-95A, manufactured by URE-TECH CO., Ltd. Other applicable thermoplastic urethanes include Desmopan® from Bayer and Pebax® from Atofina.

The flexible members 50*a* and 50*b* may be formed of a thermoplastic urethane that is substantially softer than the first and second layer material for additional flexibility of the forefoot portion 20. Preferably, the flexible members 50*a* and 50*b* have a hardness of less than about 85 Shore A and more preferably about 70 Shore A. One recommended material is manufactured by URE-TECH CO., Ltd. under the name U-70AP and has a Shore A of about 70.

While it is apparent that the invention herein disclosed is well calculated to fulfill the objects above stated, it will be appreciated that modifications and embodiments may be devised by those skilled in the art. For example, other types of connections, such as latches or clamps may also be used in place of the ball-and-socket connection to provide independent and relative movement of the forefoot and shank-heel portions. The outsole 16, and features thereof discussed above may be used with other types of shoes, not just golf shoes. The flexible member can be used with shoes with other constructions and particularly golf shoes with or without the ball-and-socket connection. In addition, the gel cushions can be used with shoes with other constructions and particularly golf shoes with or without the ball-and-socket connection. The appended claims cover all such modifications and embodiments as fall within the true spirit and scope of the present invention.

What is claimed is:

1. An outsole comprising:

a forward portion;

a rearward portion;

a torsion member having means for rotationally coupling the forward portion to the rearward portion at a pivot just behind a transverse arch of a user;

the torsion member including a plurality of shock absorbing angled stabilizer rods, the stabilizer rods having proximal ends telescopically disposed within channels defined in the rearward portion to provide a reciprocating movement therein, wherein the forward and rearward portions are operatively connected and stabilized to freely allow independent and relative movement of the forward and rearward portions rotationally and about the pivot while walking.

2. The outsole of claim 1, wherein the coupling means comprises:

a housing having elongated slots for receiving distal ends of the stabilizer rods;

a projecting member extending from the housing, a distal end of the projecting member having a rounded protrusion; and a connector disposed in a recess of the forward portion, the connector having defined therein an internal chamber of a size and configuration for accepting the projecting member.

3. The outsole of claim 1, wherein the reciprocating movement of the stabilizer rods within the channels of the rearward portion is between about 0.24 inch and 0.28 inch.

4. The outsole of claim 1, wherein the stabilizer rods comprise two rods, each positioned at an angle of between about 1 to 15 degrees from a longitudinal axis.

5. The outsole of claim 1, wherein the stabilizer rods comprise two rods, each positioned at an angle of between about 3 to 10 degrees from a longitudinal axis.

6. The outsole of claim 1, wherein the forward section is comprised of a first flexible member connecting a toe piece to one side of a mid-foot piece, and a second flexible member connecting the opposing side of the mid-foot piece to a forefoot piece.

7. The outsole of claim 6, wherein the first flexible member is located substantially below the distal phalanges of a user.

8. The outsole of claim 6, wherein the second flexible member is located substantially below the metatarsal bones of a user.

9. The outsole of claim 6, wherein the flexible members are softer than the toe, mid-foot and forefoot pieces.

10. The outsole of claim 6, wherein each of the toe piece, mid-foot piece and forefoot piece materials have Shore A hardness of greater than about 75.

11. The outsole of claim 6, wherein the flexible member material has a Shore A hardness of less than about 85.

12. The outsole of claim 6, wherein the toe piece, the mid-foot piece, the forefoot piece, and the heel section materials have a Shore A hardness of greater than about 85, and the material of the flexible members have a Shore A hardness of about 70.

13. The outsole of claim 12, wherein the heel section material has a Shore A hardness of greater than about 75.

14. The outsole of claim 12, wherein the ball-and-socket connection is configured to allow relative movement of the forward and rearward portions during walking or swinging of a golf club.

15. The outsole of claim 1, wherein are the forward and rearward portions comprise extended second layers to provide increased traction and area of contact with the turf, and therefore greater stability and balance for the user.

* * * * *